United States Patent [19]

Clebant

[11] 4,224,723

[45] Sep. 30, 1980

[54] FLEXIBLE CONNECTION DEVICE

[75] Inventor: Jean C. Clebant, Carbon-Blanc, France

[73] Assignee: Societe Europeenne de Propulsion, Puteaux, France

[21] Appl. No.: 970,360

[22] Filed: Dec. 18, 1978

[30] Foreign Application Priority Data

Sep. 12, 1978 [FR] France ..... 78 26149

[51] Int. Cl.[2] ..... A44B 21/00

[52] U.S. Cl. ..... 24/263 R; 405/202

[58] Field of Search ..... 24/263 R; 405/202, 224, 405/226; 403/220, 120, 409; 114/230

[56] References Cited

U.S. PATENT DOCUMENTS

| | | | |
|---|---|---|---|
| 3,720,066 | 3/1973 | Vilain | 405/202 |
| 3,766,582 | 10/1973 | Lloyd et al. | 405/202 X |
| 4,058,137 | 11/1977 | Saint Palais et al. | 405/224 |

FOREIGN PATENT DOCUMENTS

| | | | |
|---|---|---|---|
| 709295 | 5/1931 | France | 403/220 |
| 773753 | 9/1934 | France | 403/220 |

*Primary Examiner*—J. Franklin Foss

*Attorney, Agent, or Firm*—Bill B. Berryhill

[57] ABSTRACT

The connection is of the Cardan type comprising a rigid intermediate structure, a first modular assembly of flexible connection elements placed between the intermediate structure and the first rigid body to allow relative rotation of the structure and of the first rigid body about a first axis x—x, and a second modular assembly of flexible connection elements placed between the intermediate structure and the second rigid body to allow the relative rotation of the structure and of the second rigid body about a second axis. The first and second assemblies comprise flexible bearings and abutments fabricated, at least partly, from a resilient material.

This device is particularly suitable for anchoring a floating platform to the sea bed.

12 Claims, 5 Drawing Figures

FLEXIBLE CONNECTION DEVICE

Figure 1:
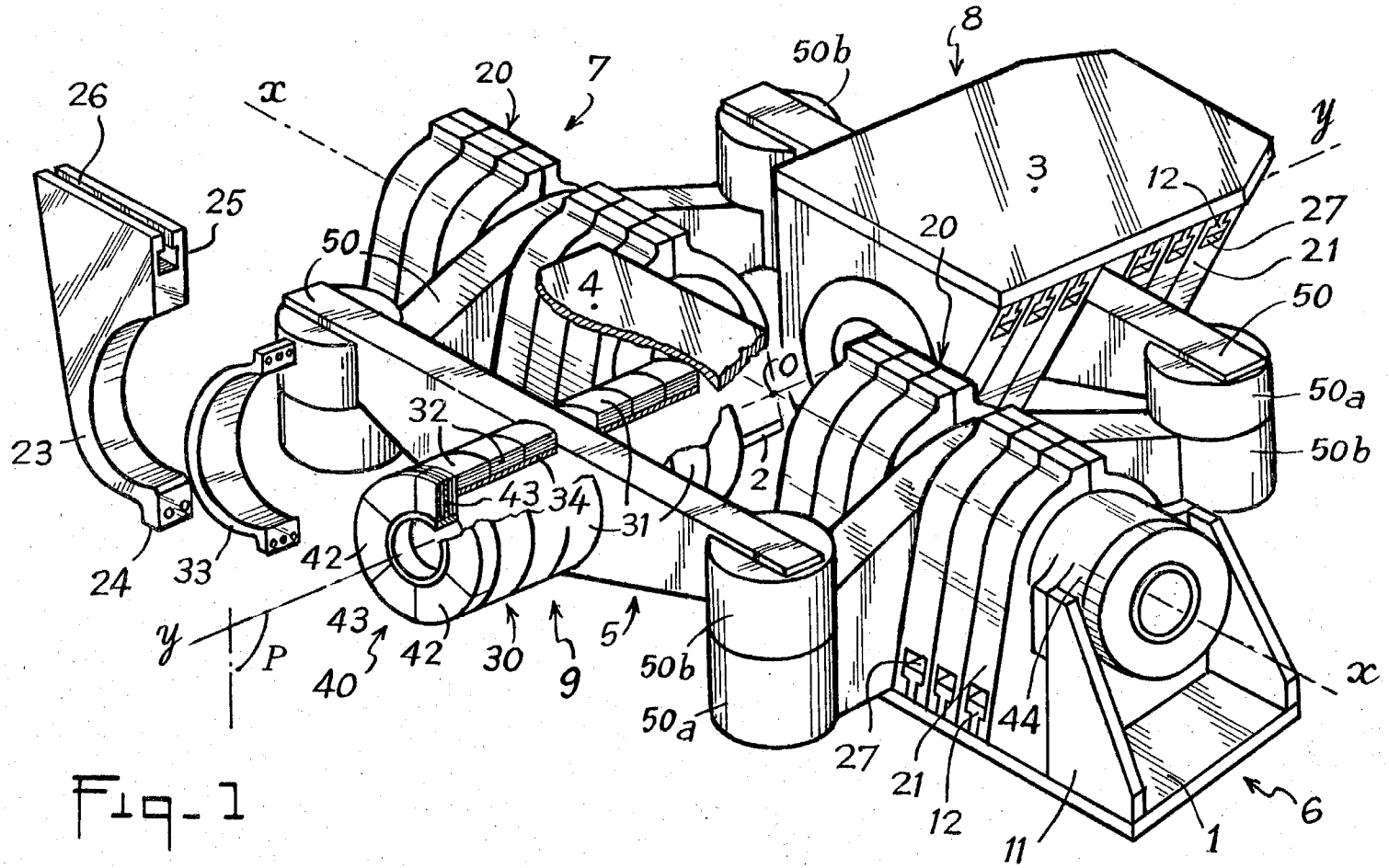

The present invention relates to a flexible connection device, and in particular to a device for transmitting high forces between first and second rigid bodies adapted to be impelled with relative movements of rotation of limited amplitude about a central point at the connection level.

A special field of application of a device according to the invention is the anchoring of floating platforms on the sea bed. The anchoring on the sea bed of a rocking platform with a positive or negative water-line, subjected to strong lateral thrusts and torsional stresses, raises particularly difficult problems in view of the required amplitude to allow for the oscillations such amplitude can reach 20° on either side of the vertical—, of the intensity of the forces to be transmitted—several thousands and even tens of thousands tons—and of the variety of the forces exerted on the connection device.

In the case of a conduit connection or riser, connecting a drilling platform to the sea bed, it is known that it is most efficient to use flexible ball and socket joints whose function is to ensure sealing, the transmission of the forces and to allow limited gradients. Known flexible ball and socket joints comprise stacks of alternated spherical layers of a rigid material, such as metal, and a resilient material, such as rubber.

An increase in the forces to be transmitted through such flexible joints requires an increase in their dimensions. When the forces are to be supported by a device connecting a floating platform to the sea bed, the dimensions to be anticipated are such that they lead to a technological impossibility. Indeed, the vulcanization of rubber, when producing stratified elements, leads to major technological difficulties and thus to very high redhibitory costs. In the present state-of-the-art, one cannot contemplate producing, in an acceptable condition semispherical thrust bearings of a diameter greater than 2.5 mm.

It is the object of the present invention to produce a flexible connection device capable of transmitting very high forces between two rigid bodies adapted to oscillate with respect to each other with a limited angular amplitude, which device uses, in order to allow these movements, flexible elements placed between the two rigid bodies, made, at least partly of a resilient material, and which can be produced without any special difficulties.

This object is attained with a connection device therein, according to the invention, the connection is of the Cardan type and comprises a rigid intermediate structure, a first modular assembly of flexible connection elements placed between the intermediate structure and the first rigid body, to allow the relative rotation of the structure and of the first rigid body about a first axis, and a second modular assembly of flexible connection elements placed between the intermediate structure and the second rigid body to allow the relative rotation of the structure and of the second rigid body about a second axis, the first and the second axis converging to the said central point.

The modular arrangement of the assemblies of flexible connecting elements has two main advantages. In the first place, the individual elements may be of small enough dimension not to raise any manufacturing problems when they are constituted, at least partly, of rubber. Secondly, the modular structure considerably simplifies the manufacture and maintenance operations.

The first and second modular assemblies comprise flexible bearings whose axes are the first and second axes and flexible abutments situated at least at one of the ends of the bearings, each flexible connection element forming part of a bearing or of an abutment being easily dismantled and re-assembled independently of the other elements. In this way, the elements of the connection device may be inspected or replaced without interrupting the operation, which is a considerable advantage in the case of a device used to anchor a floating platform to the sea bed.

One special feature of the device according to the invention is that each bearing is modular and is constituted of a plurality of juxtaposed sections separated from one another along radial planes so that each resilient connection element of a bearing section can be dismantled and re-assembled by translation perpendicular to the axis of the bearing.

Each bearing section of a modular assembly is then housed in a collar which is movably mounted on the rigid body associated to the said modular assembly, and is accessible by moving at least part of the said collar perpendicularly to the axis of the bearing.

Another special feature of the device according to the invention is that each flexible abutment is constituted of rings or ring sectors arranged in opposite manner and is double-acting so that, along each bearing axis, a single abutment is enough to recover the axial forces whatever their direction.

Advantageously, the flexible connection elements forming the bearings and the abutments are produced by successive rings of resilient material and rigid material alternated.

Other features and advantages of the connection device according to the invention will be more readily understood from the following description given by way of a non-restrictive example, reference being made to the accompanying drawings, in which:

FIG. 1 is a diagrammatical general perspective of a connecting device according to the invention, partly stripped and split, and FIGS. 2 to 5 are diagrammatical partial views of the successive stages of the dismantling of a bearing.

The connection device shown in FIG. 1 connects first rigid supporting elements 1,2 is adapted to be made integral with a first body, such as the sea bed for example, to second rigid supporting elements 3, 4 adapted to be made integral with a second body, such as a floating platform connected to supports 3, 4 by means of rigid columns (not shown).

The connection is of the Cardan type and is designed so as to allow, on the one hand, a movement of rotation about an axis x—x between the supports 1,2 and a rigid intermediate structure 5 shaped as a frame and, on the other hand, a movement of rotation about an axis y—y between the intermediate structure 5 and the supports 3,4.

Axes x—x and y—y are perpendicular and converge to a point 0 such being the center point about which the supports 3,4 can rotate, with respect to the supports 1,2, with a limited angular amplitude. In the case of the anchorage of a floating platform to the sea bed, said amplitude may be limited to values less than 20° with respect to the vertical passing through point 0.

In the illustrated example, the connection device according to the invention is constituted by four identical units 6,7,8,9 respectively mounted on the supporting elements 1,2,3,4.

Each unit 6,7 comprises a part 50 of the intermediate structure, a rigid cylindrical bearing 20 of axis x—x mounted on the support 1,2, a rigid abutment 11 mounted on the support 1,2 or being integral with the said support and situated at at least one axial end of the bearing 20, a rigid cylindrical core 51 of axis x—x either integral with or mounted on the part of structure 50 and extending inside the bearing 20, a flexible cylindrical bearing 30 of axis x—x placed between the core 51 and the rigid bearing 20 and a flexible abutment 40 placed between the rigid abutment 11 and the end of the flexible bearing 30 on the side of abutment 11.

The units 6, 7 are symmetrical with respect to the plane perpendicular to the axis x—x passing through point 0. A gap is left between units 6,7.

The units 8,9 are both symmetrical with respect to the plane perpendicular to the axis y—y passing through point 0 and they occupy, with respect to said axis, a position which is offset by 180°, compared with the position occupied by the units 6, 7 with respect to the axis x—x.

Parts 5 of the structure 5 make up the four sides of said structure. Means of assembly for the male and female respectively, are provided at ends 50*a*, 50*b* of each part 50. Thus, the units 6,7 being for example anchored on the sea bed, the units 8, 9 disposed upside down with respect to the units 6,7, are then lowered down to be assembled to the latter. Advantageously, the said assembly is produced simply by a relative vertical movement between the parts of structure, their ends 50*a* being provided with projections which fit in and are locked, hydraulically for example, in the housings made in the ends 50*b*. Any other known assembly means may of course be used to connect together at their ends the different parts 50 of the structure 5.

The free space around the central point 0 may be used for housing a piping joint, such as a flexible ball and socket joint of the type indicated at the beginning of this description or an impervious flexible shaft allowing a dry access between the movable upper part, on the surface side, and the stationary lower part of the installations.

Moreover, the cores 51 are hollow in order to allow the passage of pipes (not shown) of axes x—x and y—y.

One, for example 9, of the units constituting the connection device according to the invention is described hereinafter in more detail.

The flexible bearing 30 is made up of a plurality of annular sections 31 juxtaposed along axis y—y and separated from one another along radial planes.

In the same way, the rigid bearing 20 is made up of a plurality of sections 21 of the same thickness as sections 31.

The bearings 20 and 30 are made up in two parts on either side of a member shaped as a cross-beam, constituting the part of structure 50, the core 51 extending on either side of said cross-beam.

The sections 31 are constituted by at least two flexible elements 32 having the shape of juxtaposed sectors separated by meridian planes, and each of which extends over an angle at the most equal to 180°.

In the example shown, each section 31 is made up of two semi-cylindrical members 32 situated on either sides of the plane P containing the axis x—x and perpendicular to the plane formed by axes x—x and y—y. Each element 32 is comprised between a rigid outer half-ring 33 and a rigid inner half-ring 34, to which half-rings adhere the end layers of the member 32.

In the same way, each section 21 is made up of two half-collars 23 which, when assembled, contain a section 31.

Each half-collar 23 is provided at one end with a lug 24 by means of which it is assembled to another half-collar 23, and at its other end, with a sole 25 having a groove 26.

Slides 12, perpendicular to the axis x—x are provided in the support 1, and in which can slide the soles 25. The slides 12 and the grooves 26 have complementary cross-sections, for example T-shaped cross-sections, as in the example shown.

The dimensions of the slides 12 and of the grooves 26 are chosen so that a vertical clearance 27 is provided between the half-collars 23 and the support 1. The half-collars are locked in position on the support by driving, for example by means of hydraulic jacks, wedges 28 (not shown on the FIG. 1) between the plane top of the slides 12 and the base of the grooves 26.

Figure 2:
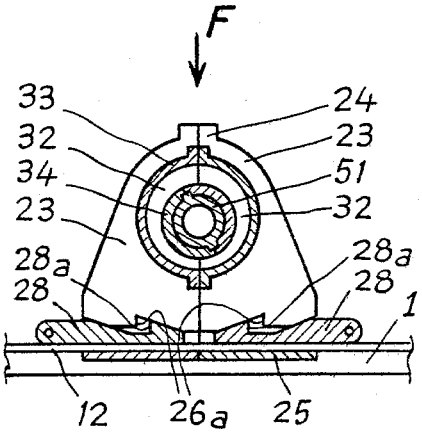
Figure 3:
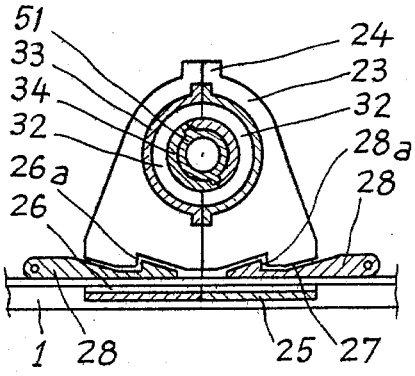
Figure 4:
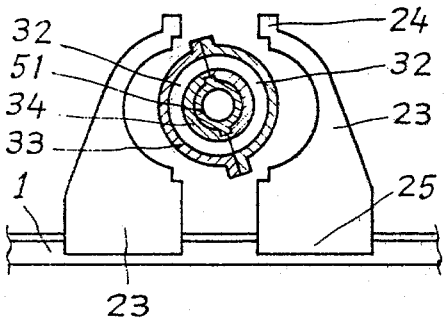

As shown on FIGS. 2 and 3, the upper face of each wedge 28 and the base of each groove 26 have two inclined surfaces which are complementary and parallel, and separated by a vertical union piece, 28*a* and 26*a* respectively.

The opposed flexible abutments 40, are constituted by rings or laminated sectors 42 situated on either side of a median disc 43 which is rigid and secured to the outer part of a core 51. The abutments 40 are thus double-acting abutments and are located in casings 44 mounted on the supporting member 11.

The flexible connecting elements 32 and 42 are constituted by superimposed layers of non-extensible rigid material and resilient material alternated, such as for example steel plate and rubber, or elastomer. The layers are joined together by vulcanization of the rubber.

The different layers constituting elements 32 are cylindrical and co-axial. In cases where the thickness of the elements 32 reaches a relatively high value in view of its mean radius, these can be produced by a plurality of superimposed sub-elements separated from one another by a cylindrical rigid fitting.

The layers constituting the abutments 40 are radial. They are continuous in laminated rings or, if the size of the parts allows it, split into sectors.

The elements 42 can be made up of a plurality of sub-elements separated from one another by rigid radial fittings if their thickness reaches a relatively high value.

During operation, the cylindrical flexible bearings ensure the transmission of the radial forces between the intermediate structure 5 and the rigid supports 1 to 4.

The flexible abutments transmit the axial forces between the structure 5 and the supports 1 to 4. In the example shown, only one abutment is associated to each bearing, which abutment is double-acting, meaning that it catches the axial thrusts in both directions. Of course, if the amplitude of the axial forces to be transmitted requires it, a flexible abutment may be placed at each axial end of each bearing.

The modular arrangement of the flexible bearings and abutments, in rigid bearings, which are themselves produced in modular manner, makes it possible to dismantle and to re-assemble any one of these constitutive elements independently of the other elements.

The dismantling of a unit (6) of the device shown in FIG. 1 is described hereinafter with reference to FIGS. 2 to 5.

The bearing is shown in FIG. 2 in the locked position. The half-collars 23 are assembled and locked in position by the wedges 28 driven by the base of the grooves 26. It will be noted that the flexible element 21 is subjected first, to a vertical force F causing the crushing of the resilient layers at the bottom, and second, to a torsional stress which causes a displacement between the meridian planes of contact of the outer half-rings 33 and inner half-rings 34.

The dismantling of an element 32 of the bearing is effected first by removing the wedges 28 (FIG. 3), thus releasing vertically the half-collars 33 and at the same time, freeing the element 32 which they contain from the vertical force F.

Figure 5:
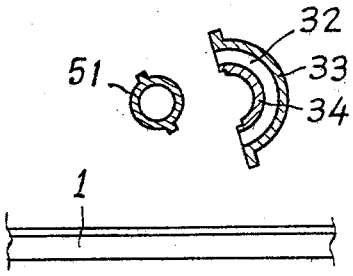

The half-collars 33 are then separated (FIG. 4), and moved apart. The element 31 is placed in a balanced position and each element 32 may be removed (FIG. 5).

In the same way, each element 42 may be removed after dismantling of the casing 44 containing it and possible compensation of the axial force to which it is subjected.

Thus, each of the flexible elements 32, 42 is accessible for control or replacement without interrupting the operation of the connection device. The number and the distribution of the flexible elements 32, 42 are then determined not only in relation to the maximum actions exerted thereupon, but also in order to allow the dismantling of one of them whilst retaining for the whole device assembly a coefficient of safety which is acceptable to the nominal conditions of load.

Various modifications or additions may of course be brought to the embodiment hereinabove described of a device according to the invention without departing from the scope of protection defined by the accompanying claims.

I claim:

1. A flexible connection device for transmitting high forces between first and second rigid bodies adapted to be impelled with relative movements of rotation of limited amplitude, about a central point situated at the connection level, in which device the said relative movements are allowed by the positioning, between the rigid bodies, of connecting elements made, at least partly, of resilient material, wherein the connection is of the Cardan type and comprises a rigid intermediate structure, a first modular assembly of flexible connection elements placed between the intermediate structure and the first rigid body to allow the relative rotation of the structure and of the first rigid body about a first axis, and a second modular assembly of flexible connection elements placed between the intermediate structure and the second rigid body to allow the relative rotation of the structure and of the second rigid body about a second axis, the first and second axes converging in said central point.

2. A device as claimed in claim 1, wherein the first and second modular assemblies comprise flexible bearings whose axes are in the first and second axes and flexible abutments situated at least at one end of the bearings, each flexible connection element forming part of a bearing or of an abutment being easily dismantled or re-assembled independently of the other elements.

3. A device as claimed in claim 2, wherein each bearing is modular and is constituted of a plurality of juxtaposed sections separated from one another along radial planes so that each flexible connection element of a section can be dismantled and re-assembled by translation perpendicularly to the axis of the bearing.

4. A device as claimed in claim 3, wherein each bearing section of a modular assembly is housed in a collar which is movable mounted on the rigid body associated to the said modular assembly, and is accessible by moving at least part of the collar perpendicularly to the axis of the bearing.

5. A device as claimed in claim 4, wherein each section of a flexible bearing is composed of a plurality of flexible connection elements each one occupying a volume defined by two co-axial cylindrical surfaces of different radii, two radial planes and two meridian planes forming between them an angle at the most equal to 180°.

6. A device as claimed in any one of claim 2 to 5, wherein each flexible connection element of a bearing is constituted by the superimposition of cylindrical co-axial layers of rigid material and resilient material alternated.

7. A device as claimed in any one of claim 2 to 5, wherein each flexible abutment is modular and is constituted of rings or ring sectors situated in opposition so as to catch the axial thrusts in the two dieections.

8. A device as claimed in any one of claim 2 to 5, wherein each connection element of a flexible abutment is constituted by the superimposition of radial layers of resilient material and rigid material alternated.

9. A device as claimed in claim 1, which is constituted of four identical units each comprising: a rigid support, a portion of the intermediate structure; a flexible cylindrical bearing placed between the rigid support and the said portion of the intermediate structure, a flexible abutment situated at at least one end of the flexible bearing; a rigid bearing containing the flexible bearing and mounted on the rigid support; a rigid bearing supported axially by the flexible abutment and mounted on the rigid support or being integral therewith; and a rigid core housed in the flexible bearing and mounted on said portion of intermediate structure or being integral therewith.

10. A device as claimed in claim 9, wherein the rigid bearing element is constituted of juxtaposed identical collars each containing a section of flexible bearing, the collars being movable assembled to the rigid support and being provided with a guiding surface to allow their dismantling and their re-assembly, by translation perpendicularly to the axis of the bearing, without moving the adjacent collars.

11. A device as claimed in any one of claim 9 or 10, wherein its four constitutive units are grouped in a first pair of units aligned together along the first axis, and placed symmetrically to each other with respect to the plane which is perpendicular to the first axis passing through the central point, and a second pair of units aligned together along the first axis and placed symmetrically to each other with respect to the plane which is perpendicular to the second axis passing through the central point, the units of the first pair and those of the second pair being offset by 180° with respect to the first axis.

12. A device as claimed in any one of claim 9 or 10 wherein the portions of intermediate structure are provided with locked connection means to allow their mutual assembly.

* * * * *

UNITED STATES PATENT OFFICE

CERTIFICATE OF CORRECTION

Patent No. 4,224,723 Dated September 30, 1980

Inventor(s) Jean Claude Clebant

It is certified that error appears in the above-identified patent and that said Letters Patent are hereby corrected as shown below:

Column 5, line 58, after "are", delete "in";

Column 6, line 5, "movable" should be -- movably --;

Column 6, line 45, "movable" should be -- movably --.

Signed and Sealed this

Tenth Day of February 1981

[SEAL]

Attest:

RENE D. TEGTMEYER

Attesting Officer

Acting Commissioner of Patents and Trademarks